United States Patent [19]

Wilson et al.

[11] 4,398,724

[45] Aug. 16, 1983

[54] VOLLEYBALL NET TOUCH DETECTING AND INDICATING SYSTEM

[76] Inventors: Wayne D. Wilson, 4934 Turquoise Cir., Colorado Springs, Colo. 80917; James J. Joyce, 7630 Topin Rd., Colorado Springs, Colo. 80908

[21] Appl. No.: 350,500

[22] Filed: Feb. 19, 1982

[51] Int. Cl.[3] ..... A63B 71/06; A63B 61/00

[52] U.S. Cl. ..... 273/411; 273/29 B; 340/323 R

[58] Field of Search ..... 434/411, 29 B, 31; 340/323 R

[56] References Cited

U.S. PATENT DOCUMENTS

| | | | |
|---|---|---|---|
| 3,415,517 | 12/1968 | Krist | 273/31 |
| 3,860,240 | 1/1975 | Koch | 273/411 |
| 3,940,139 | 2/1976 | Barnes | 273/411 |
| 4,081,798 | 3/1978 | Pelfrey | 340/323 R |

FOREIGN PATENT DOCUMENTS

| | | | |
|---|---|---|---|
| 651822 | 3/1979 | U.S.S.R. | 273/411 |

*Primary Examiner*—William H. Grieb

*Attorney, Agent, or Firm*—Donald J. Singer; Williard R. Matthews

[57] ABSTRACT

Volleyball net touch violations are detected and an indicator identifying the offending team is actuated by a system that incorporates antennas into the volleyball net and utilizes radiant energy generated by court illuminating lights. A wire mesh antenna is affixed to each side of the net. The outputs of the antennas are amplified and compared with a reference. A player touching either net adds capacitance to the system producing a measurable signal. A NAND gate logic circuit determines which net was touched and actuates the appropriate indicator. The system does not respond to the volleyball which is a dielectric material does not add capacitance to the system.

8 Claims, 9 Drawing Figures

FIG. 2
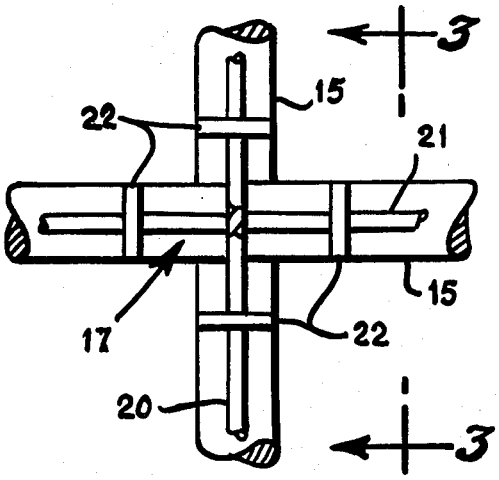
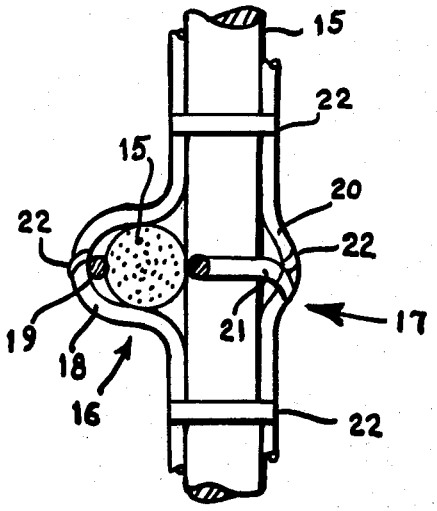
FIG. 3
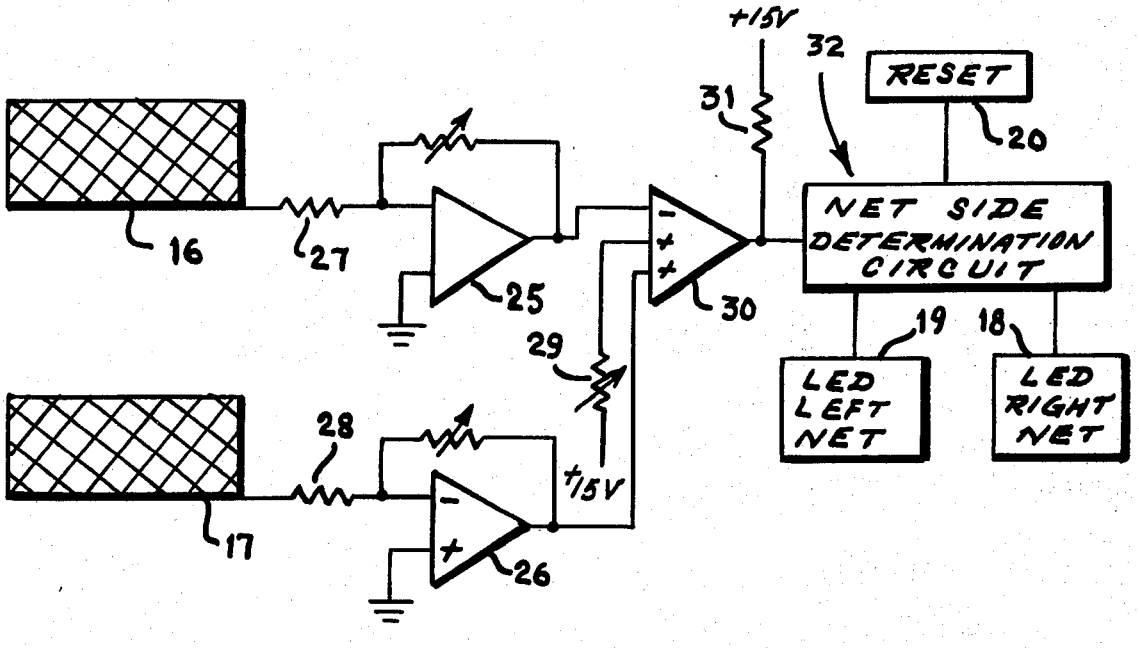
FIG. 4

| INPUT | | OUTPUT |
|---|---|---|
| 0 | 0 | 1 |
| 0 | 1 | 1 |
| 1 | 0 | 1 |
| 1 | 1 | 0 |

VOLLEYBALL NET TOUCH DETECTING AND INDICATING SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to volleyball officiating aids and in particular to a volleyball net touch violation detecting and indicating system for improving the quality of judgement calls by officials during play.

Net touch violations in a fast paced volleyball game are difficult to detect and frequently require a judgement call by the official refereeing the game. If two or more players are in the vicinity of the net when an infraction occurs it is difficult to tell which player on which team is at fault. When players from both teams violate the net within fractions of a second of each other it is almost impossible to determine which player was the first violator and should be charged with the penalty. Furthermore, a volleyball may strike the net while two or more players are in the vicinity. If the official's view is obstructed by other players he sees only the net movement and the other players and his judgement as to which team, or the ball, caused net movement may be in error.

In view of these officiating difficulties it is apparent that some means for automatically detecting and indicating net touch violations is highly desirable. Although a system for achieving this would be primarily used as an officiating aid it would also be useful in unofficial games with no official and would allow the players to make net touch calls they could not otherwise make.

The present state of the art does not provide for such a system, however. The U.S. Pat. No. 4,081,798 of L. F. Pelfrey entitled Let Ball Detector issued Mar. 28, 1978 discloses a system that indicates when a ball strikes the top of a net. The system does not distinguish between player and ball and does not indicate on which side of the net the infraction occured.

In accordance with the foregoing discussion it is seen that there currently exists the need for a volleyball net touch detecting and indicating system that indicates which team caused the violation and that discriminates between player and ball. The present invention is directed toward satisfying that need.

SUMMARY OF THE INVENTION the invention is a volleyball net touch detecting and indicating system that utilizes antennas attached to the volleyball net which receive the background noise given off by the gymnasium lights as a net touch sensing means. A player touching the net adds capacitance to it increasing its gain a measurable amount. A separate antenna is attached to each side of the net. The antenna outputs are amplified and compared to a reference in a comparator. The comparator outputs a signal when a player touches the net (antenna on his side of the net) and a logic circuit determines which net side (antenna) has been touched. Visual indication in the form of LEDs are actuated by the logic circuit in response to net touch events. The logic circuit also disables the other LED display when one is actuated after which the system must be reset. Net touch by the volleyball does not actuate the system since it is of dielectric material and does not add capacitance to the antenna. The system can also be implemented by using a low frequency (LF) to microwave frequency transmitter instead of the gymnasium lights when outdoor play is desired.

It is a principal object of the invention to provide a new and improved volleyball net touch detecting and indicating system.

It is another object of the invention to provide a net touch detecting and indicating system that is simple and inexpensive and can be fabricated of readily available components.

It is another object of the invention to provide a net touch detecting and indicating system that distinguishes between players and volleyball.

These togethert with other objects, features and advantages of the invention will become more readily apparent from the following detailed description when taken in conjunction with the illustrative embodiment in the accompanying drawings.

DESCRIPTION OF THE DRAWINGS

FIG. 2 is a detail of a portion of the net of the court of FIG. 1 showing one method of affixing an antenna means;

FIG. 3 is a sectional view of the detail of FIG. 2 taken at 3—3;

FIG. 4 is a general block diagram of the volleyball net touch detecting and indicating system of the invention;

DETAILED DESCRIPTION OF THE PREFERRED EMBODIMENT

The net touch detection system of the invention is composed of four basic subsystems: a wire mesh antenna in the net, an amplifier, a comparator, and a net side determination circuit. The wire mesh can consist of 20 gauge stranded wire sections which can be taped to individual net strands or they can be interwoven through the existing volleyball net. This mesh acts as an antenna for the 60 Hertz background noise given off by the gymnasium lights. The volleyball net serves as insulation between the two wire meshes necessary for the detection system.

The amplifier system amplifies the signal received by the net antenna to a useable level. A suitable amplifier for this purpose is the SN72741C operational amplifier. Operation of this subsystem is hereinafter described in detail. the actual net violation is detected in the comparator system. The comparator can be, for example, an LM3302 comparator. This integrated circuit compares an input voltage to a reference voltage. The final component of this subsystem is the net side determination circuitry. This system displays which side of the net was first touched. It also "locks out" the other side so that once a touch is registered, no other touch will be displayed until the system is reset. The net side determination system is a combination of NAND logic and light emitting diodes (LEDs) used to display an infraction on the net.

The above described subsections are combined to provide the net touch detection system. When the net is touched an LED is turned on to indicate which side of the net was violated. The system is reset by using a reset switch.

Figure 1:
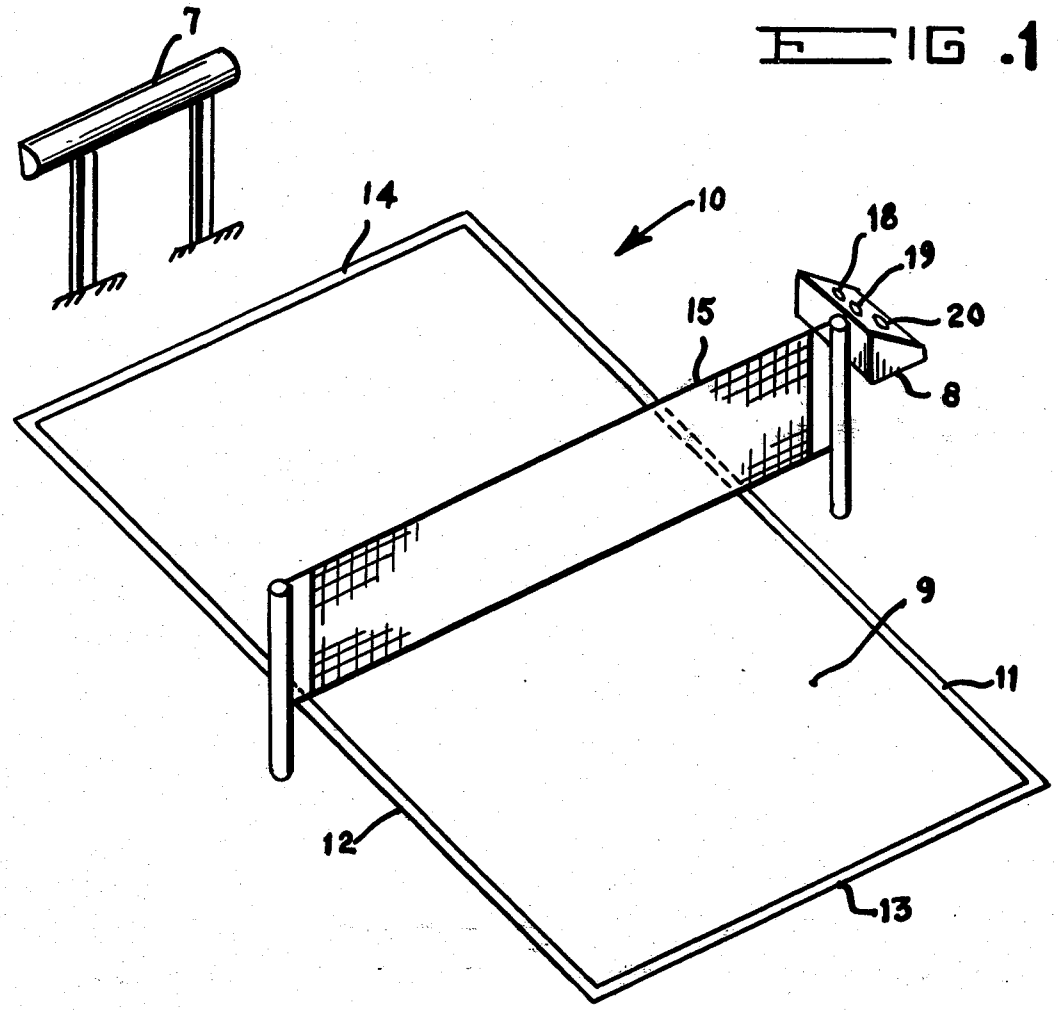
FIG. 1 is an isometric view of a volleyball court incorporating the volleyball net touch detecting and indicating system of the invention.

Referring now to FIG. 1 there is illustrated thereby a volleyball court 10 incorporating the net touch detecting system of the invention. It comprises a playing surface 9 defined by sideline bounds 11, 12, endline bounds 13, 14, and net 15. The net touch detecting system includes radiant energy source 7, which can be a low frequency (LF) to microwave frequency transmitter, or simply the gymnasium lights, display console 8 having LED indicators 18, 19 and reset switch 20, and antenna means (not shown) on each side of net 15. The antenna means can be realized by cutting horizontal and vertical lengths of conductor to net size and affixing them to each side of the net. In the event the net is constructed with knots at each strand crossing the wire mesh can be woven through the knots and the intersections taped together with electrical tape to ensure contact across the entire mesh. The single final strand from one end of the mesh is extended to the amplifier and control circuitry. FIGS. 2 and 3 which together constitute a detail of a net section illustrate a similar method of fabricating the antennas. Vertical conductors 18, 20 and horizontal conductors 19, 21 are taped to net strands 15 by means of electrical tape 22. Conductors 20, 21 are also taped together at their crossover point as are conductors 18, 19.

FIG. 4 is a block diagram of the completely integrated system and comprises atennas 16, 17, resistors 27, 28, 31, operational amplifiers 25, 26, comparator 30, net side determination circuit 32, reset switch 20, left net indicator 19 and right net indicator 18.

Figure 5:
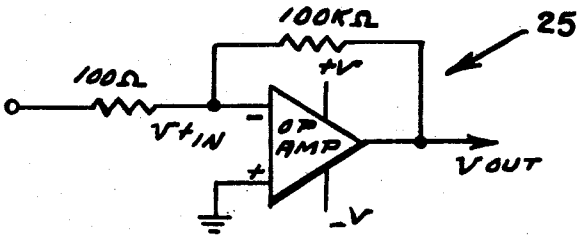
FIG. 5 is a schematic of the amplifier stage of the invention.

Amplifiers 25 and 26 are SN72741C operational amplifiers. by configuring this integrated circuit with 100 kΩ resistor and a 100Ω resistor, an amplifier with a gain of 1000 is achieved. The configuration of this amplifier and its component values are shown in FIG. 5. With a gain of 1000, the voltage output from the amplifier is equal to 1000 times the input voltage. Design data for the amplifier are given below.

For the amplifier, the following equation is used to find the gain.

$$\text{GAIN} = R_f/R_s$$

$$R_f = 100\ \text{k}\Omega$$

$$R_s = 100\Omega$$

$$\text{GAIN} = 100\ \text{k}\Omega/100\Omega = 1000$$

The operating characteristics for the SN72741C are:

$V^+ = +15$ V
$V^- = -15$ V Supply Voltage

Supply Current = 1.7 mA

Figure 6:
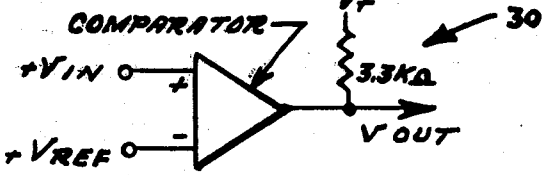
FIG. 6 is a schematic of the comparator stage of the invention.

Using the LM3302 comparator, the circuit compares an input voltage to a reference voltage. When the input is less than the reference, the output of the comparator is 0 volts. When the input voltage is greater than the reference volrtage, the output voltage goes to 5 volts. Therefore, when the net is touched and the amplitude of the signal jumps to a voltage that exceeds the reference voltage, the output of the comparator is 5 volts. This is how a touch is detected. The diagram of this circuit (FIG. 6) shows the comparator configuration. For the comparator, the following characteristics are given:

$V^+ = +15$ V $V^- = -15$ V Supply Voltage

Supply Current = 0.8 mA

Figure 7:
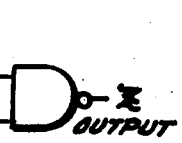
FIG. 7 is a schematic illustration of a NAND gate of the type used in the invention together with its logic truth table.
Figure 8:
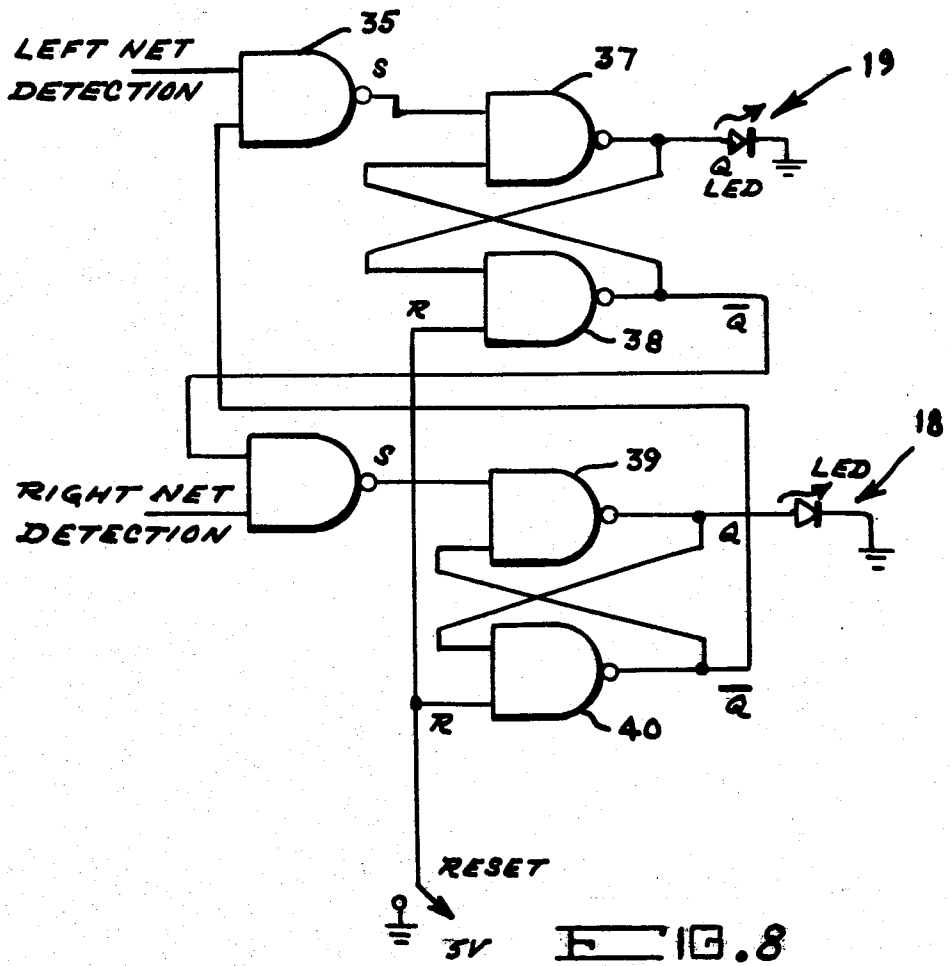
FIG. 8 is a schematic diagram of the net side determination circuit of the inventnon.

The net side determination logic circuit is shown schematically by FIG. 8. It comprises NAND gates 35–40 arranged and interconnected as shown. As shown, the NAND logic is configured to make a Set-Reset (S-R) flip-flop. NAND logic is also used as the "lock out" portion of this subsystem. The table of NAND logic in FIG. 7 shows the logic relationships. The outputs of the S-R flip-flop, Q and $\bar{Q}$ are always opposite. When Q = 3.4 volts, $\bar{Q}$ = 0 volts. For the LED on one side to be on (FIG. 7), Q must be 3.4 V for that side. To set Q 3.4 V, the input S must be changed from 3.4 V to 0 V to 3.4 V. Initially the system is set with Q and $\bar{Q}$ to 0 and 3.4 volts respectively. Therefore, due to the NAND gate preceding the set input, a pulse from 0 V to 3.4 V to 0 V on the input to this NAND gate will cause a 0 volt pulse on the output, and set the output Q on this side to 3.4 V and light the LED. The LED requires 2 volts to be lit.

Now that Q has been set to 3.4 V and $\bar{Q}$ is set to 0 V, the other system has been locked out. By examining the NAND logic figure of FIG. 8, when one of the inputs to a NAND gate is 0 V, the output is always 3.4 volts. Therefore, a zero voltage on the other input to this NAND gate will cause this S-R flip-flop to be set and thus "locked out." To reset the system, 0 volts is applied to one of the NAND gates of the S-R flip-flop. This causes Q to go to 0 V and $\bar{Q}$ to go to 3.4 V. Now both sides are once more enabled and the LEDs are turned off. The reset switch for this circuit is available to the referee on the display console.

Figure 9:
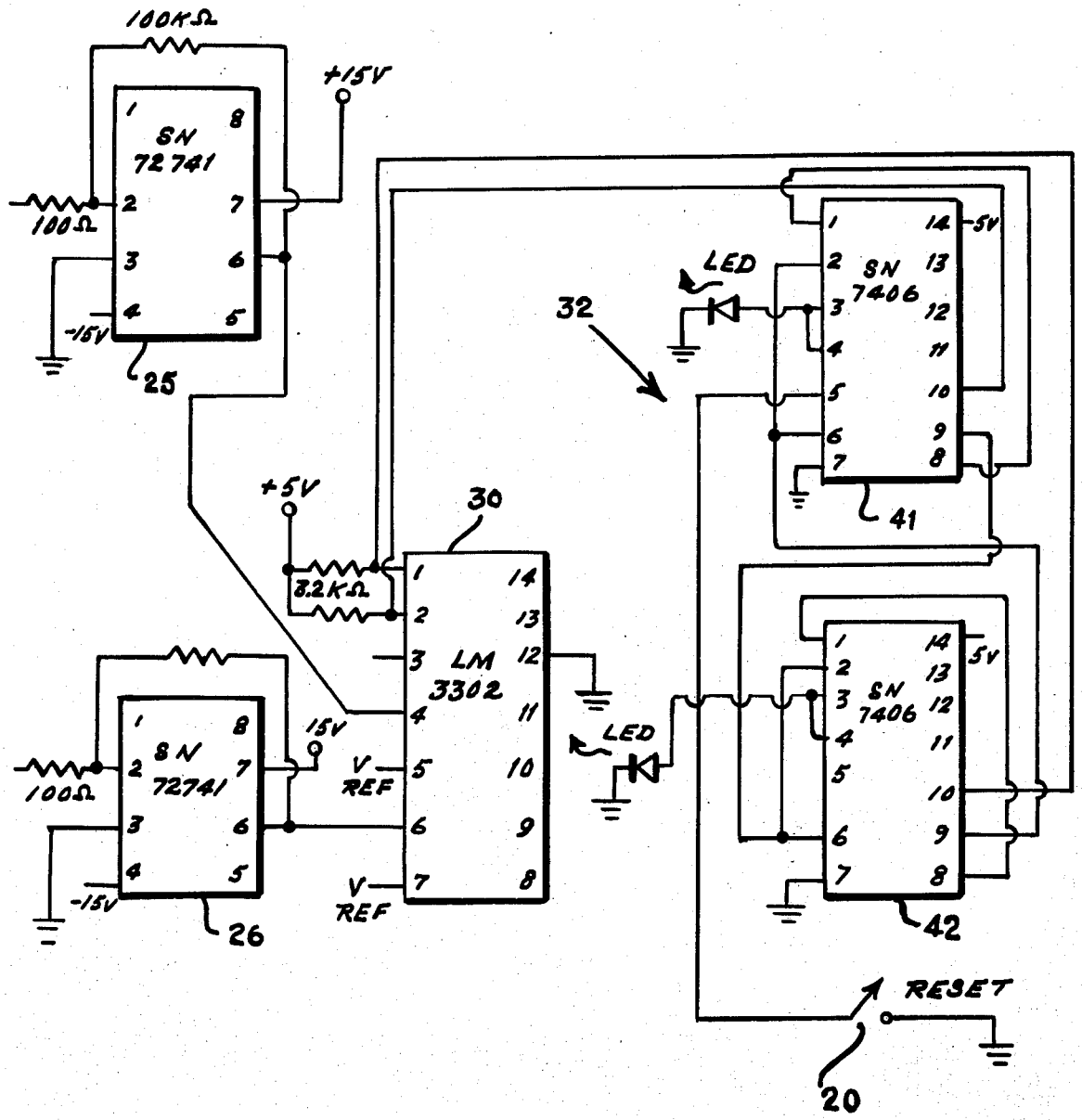
FIG. 9 is a PIN diagram of the components of FIG. 4.

For the S-R flip-flop (NAND gate, SN7400) the following characteristics are given:

$V^+ = 5$ V Supply Voltage $V_{IH} = \text{min } 2$ V $V_{IL} = \text{max } 0.8$ V Input Voltages $V_{OH} = 3.4$ V $V_{OL} = 2.$ V Output Voltages $I_{IH} = +40\ \mu\text{A}$ $I_{OH} = -400\ \mu\text{A}$ $I_{IL} = -1.6$ mA $I_{OL} = +16$ mA FIG. 9 illustrates the PIN diagram for the principal components of the system. The net discriminating logic circuit is shown as two separate IC components 41, 42.

Operation of the entire net touch detection system is performed by the referee on the display console. He resets the system and reads the LEDs to determine the team which has been detected as violating the net. He calls the infraction with the assistance of this detection system.

While the invention has been described in one presently preferred embodiment, it is understood that the words which have been used are words of description rather than words of limitation and that changes within the purview of the appended claims may be made without departing from the scope and spirit of the invention in its broader aspects.

What is claimed is:

1. In combination with a volleyball court having a playing surface defined by sideline and endline bounds and a net positioned at center court, a volleyball net touch detecting and indicating system comprising a source of radiant energy, a first antenna means affixed to and substantially coextensive with one side of said net receiving said radiant energy, a second antenna means affixed to and substantially coextensive with the opposite side of said net receiving said radiant energy;

means for amplifying the output of said first antenna means, means for amplifying the output of said second antenna means, comparator means receiving the amplified outputs of said first and second antenna means and outputting signals responsive to player net touch events, a first indicator means for designating player touch events of said first antenna means, a second indicating means for designating player touch events of said second antenna means, and a net side determination circuit receiving the outputs of said comparator means and enabling said first indicating means in response to a net touch of said first antenna means and said second indicating means in response to a net touch of said second antenna means.

2. A volleyball net touch detecting and indicating system as defined in claim 1 wherein said source of radiant energy comprises electric lights proximately positioned to and illuminating said volleyball court.

3. A volleyball net touch detecting and indicating system as defined in claim 2 wherein aid first and second antenna means each comprises a wire mesh.

4. A volleyball net touch detecting and indicatng system as defined in claim 3 wherein said means for amplifying the outputs of said first and second antenna means each comprise an operational amplifier.

5. A volleyball net touch detecting and indicating system as defined in claim 4 wherein said first and second indicating means comprises light emitting diodes.

6. A volleyball net touch detecting and indicating system as defined in claim 5 wherein said net side determination circuit comprises a NAND gate logic circuit configured as a set-reset flip-flop.

7. A volleyball net touch detecting and indicating system as defined in claim 5 wherein said net side determination circuit comprises first, second, third, fourth, fifth and sixth NAND gates each gate having first and second inputs and an output, the first input of said first NAND gate receiving left net detection signals from said comparator means, the second input of said fourth NAND gate receiving right net detection signals from said comparator means, the second input of said first NAND gate being connected to the output of said sixth NAND gate and the second input of said first NAND gate, the output of said first NAND gate being connected to the first input of said second NAND gate, said second NAND gate having its second input connected to the output of said third NAND gate and the first input of said fourth NAND gate and its output connected to the first input of said third NAND gate and to said first indicator means, the second input of said third NAND gate being connected to the second input of said sixth NAND gate and to a reset switch, the output of said fourth NAND gate being connected to the first input of said fifth NAND gate, and the output of fifth NAND gate being connected to the first output of said sixth NAND gate, and to said second indicator means.

8. A volleyball net touch detecting and indicating system as defined in claim 1 wherein said source of radiant energy comprises means for transmitting microwave energy to said first and second antenna means.

* * * * *